US010455917B2

(12) United States Patent
Mandica et al.

(10) Patent No.: US 10,455,917 B2
(45) Date of Patent: Oct. 29, 2019

(54) DEVICE FOR DISPENSING A FLUID PRODUCT

(71) Applicant: SEB S.A., Ecully (FR)

(72) Inventors: Franck Mandica, Francheville (FR); Johan Sabattier, Mornant (FR); Régis Fereyre, Lyons (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 16/062,925

(22) PCT Filed: Dec. 6, 2016

(86) PCT No.: PCT/EP2016/079912
§ 371 (c)(1),
(2) Date: Jun. 15, 2018

(87) PCT Pub. No.: WO2017/102447
PCT Pub. Date: Jun. 22, 2017

(65) Prior Publication Data

US 2018/0368551 A1 Dec. 27, 2018

(30) Foreign Application Priority Data

Dec. 17, 2015 (FR) ..... 15 62613

(51) Int. Cl.
*A45D 34/04* (2006.01)
*A47K 5/12* (2006.01)
(Continued)

(52) U.S. Cl.
CPC ..... *A45D 34/04* (2013.01); *A45D 34/00* (2013.01); *A47K 5/1201* (2013.01);
(Continued)

(58) Field of Classification Search
CPC .... A45D 34/04; A45D 34/00; A45D 220/054; A45D 220/10; A47K 5/1201;
(Continued)

(56) References Cited

U.S. PATENT DOCUMENTS 6,390,329 B1 * 5/2002 Maddox ..... A47K 5/1202 222/207
7,438,202 B2 * 10/2008 Gross ..... A45D 27/06 222/214
(Continued)

OTHER PUBLICATIONS

International Search Report as issued in International Patent Application No. PCT/EP2016/079912, dated Feb. 20, 2017.

*Primary Examiner* — Lien M Ngo
(74) *Attorney, Agent, or Firm* — Pillsbury Winthrop Shaw Pittman LLP

(57) ABSTRACT

A device for dispensing a fluid product, includes: a container containing the product; an electric motor including a rotatably driven shaft; a dispensing system actuated by motor rotation, the quantity of product dispensed depending on the motor rotation; a switching body to control the motor; a stop control element rotatably driven by the shaft, assuming an active position during the rotation thereof in which it causes the switch to interrupt the power supply of the motor; and a restarting circuit to switch into an activated state, when triggered, to force the starting of the motor when the stop control element is in an active position, the restarting circuit remaining activated long enough for the stop control element to leave its active position, the restarting circuit becoming inactive such that the motor stops operating when the stop control element regains its active position once the restarting circuit is inactive again.

17 Claims, 2 Drawing Sheets

Figure 1:
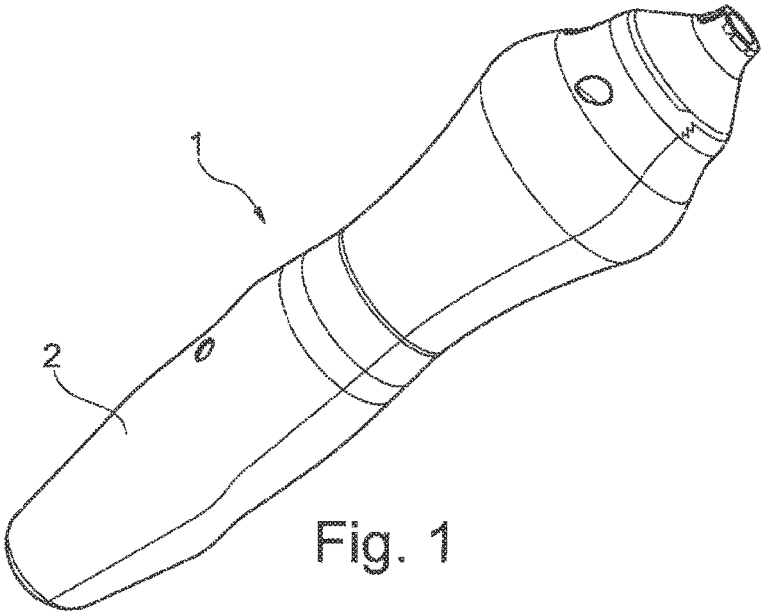

(51) Int. Cl.
*A45D 34/00* (2006.01)
*F04B 9/04* (2006.01)
*F04B 43/04* (2006.01)

(52) U.S. Cl.
CPC ..... *A47K 5/1204* (2013.01); *A47K 5/1208* (2013.01); *F04B 9/042* (2013.01); *F04B 43/04* (2013.01); *A45D 2200/054* (2013.01); *A45D 2200/10* (2013.01)

(58) Field of Classification Search
CPC ..... A47K 5/1204; A47K 5/1028; F04B 43/04; F04B 9/042
USPC ..... 222/333, 63, 207, 214
See application file for complete search history.

(56) References Cited

U.S. PATENT DOCUMENTS

| | | | | |
|---|---|---|---|---|
| 2005/0127090 | A1* | 6/2005 | Sayers | A47K 5/1217 222/1 |
| 2006/0243740 | A1* | 11/2006 | Reynolds | A47K 5/1208 222/52 |
| 2008/0189951 | A1* | 8/2008 | Molema | B26B 19/40 30/41 |
| 2011/0017778 | A1* | 1/2011 | Kadiks | A47K 5/1217 222/190 |
| 2011/0095051 | A1* | 4/2011 | Liao | A47K 5/16 222/52 |
| 2014/0103072 | A1* | 4/2014 | Pelfrey | A47K 5/1208 222/214 |
| 2014/0124531 | A1 | 5/2014 | Muderlak et al. | |

* cited by examiner

DEVICE FOR DISPENSING A FLUID PRODUCT

CROSS-REFERENCE TO RELATED APPLICATIONS

This application is the U.S. National Stage of PCT/EP2016/079912 filed Dec. 6, 2016, which in turn claims priority to French patent application number 1562613 filed Dec. 17, 2015. The content of these applications are incorporated herein by reference in their entireties.

This invention concerns the dispensing of a fluid product, and more specifically, but not exclusively, packaging and dispensing devices capable of delivering a predefined quantity of a cosmetic or dermatological product.

Dispensing devices comprising a container containing the product to be dispensed and a pump mounted on the container to dispense a dose of product when the pump is actuated are widely known.

There is a need to control electronically the quantity of product dispensed so that, for example, the product quantity applied to the treated region can be adjusted optimally.

This need exists more specifically with devices that treat human keratin materials by application of an electric current jointly with the application of a cosmetic or dermatological product, such as iontophoresis devices.

The invention thus has the objective, according to one of its aspects, of a device for dispensing a fluid product, comprising:

- a container containing said product,
- an electric motor comprising a rotatably driven shaft,
- a dispensing means actuated by the rotation of the motor, the quantity dispensed depending on the rotation of the motor,
- a switching body controlling the operation of the motor,
- a stop control element rotatably driven by the shaft, assuming an active position during the rotation thereof in which it causes the switching body to interrupt the power supply of the motor,
- a restarting circuit arranged in such a way as to switch into an activated state, when triggered, so as to force the starting of the motor when the stop control element is in an active position, the restarting circuit remaining activated long enough for the stop control element to leave its active position, the restarting circuit then becoming inactive such that the motor stops operating when the stop control element regains its active position once the restarting circuit is inactive again.

With this invention, each time the motor is actuated it is possible to act on the dispensing means and dispense a predefined quantity of product.

In one embodiment, the switching body is an electromechanical switch, and the stop control element is a cam arranged to press on the switch. In particular, the cam can act on the switch, which is normally closed, when the stop control element is in an active position. As a variant, the switch is normally open and the cam presses on the switch on practically one revolution of the shaft, except in the active position, at the place where the motor has to stop.

The use of an electromechanical switch as a switching body is a reliable and economical solution.

The switch may be electrically connected in series with the electric motor, the latter operating when the switch is closed.

As a variant, the switch controls an electronic power component or a relay that controls the operation of the electric motor. A direct control is preferable in order to reduce costs, since the current absorbed by the motor is able to stay relatively low when dispensing a cosmetic or dermatological product.

Preferably, the restarting circuit comprises a timeout defining the period during which it remains active after being triggered, this period preferably being short enough that the motor shaft makes only one turn after the restarting circuit is triggered.

Preferably again, the restarting circuit in the activated state short-circuits the switching body.

The dispensing means is preferably a pump actuated by the rotation of the shaft.

The device may include a cam arranged so as to cause a pump body to move in an actuating stroke at each revolution of the shaft.

The switch actuating cam and the pump actuating cam are preferably angularly offset on the shaft, such that the switch actuating cam actuates the switch after the pump actuating cam has actuated the pump.

The pump may be a membrane pump, with the actuating pump pressing on the membrane.

The restarting circuit can be triggered manually.

As a variant, the device may include a control circuit that automatically determines when product is needed and controls the restarting circuit so as to dispense a dose of product corresponding to the need.

The product may be of any kind, preferably being a cosmetic or dermatological product.

The device may include an electrode making it possible to subject the region treated with the product to an electric current, the device possibly being an electrophoresis appliance.

Figure 2:
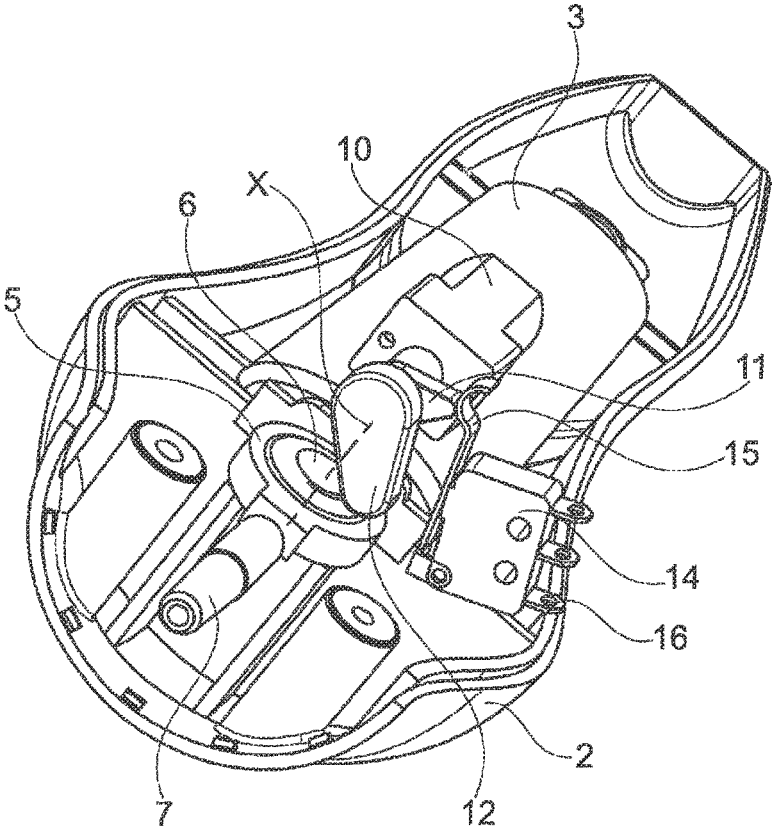
Figure 3:
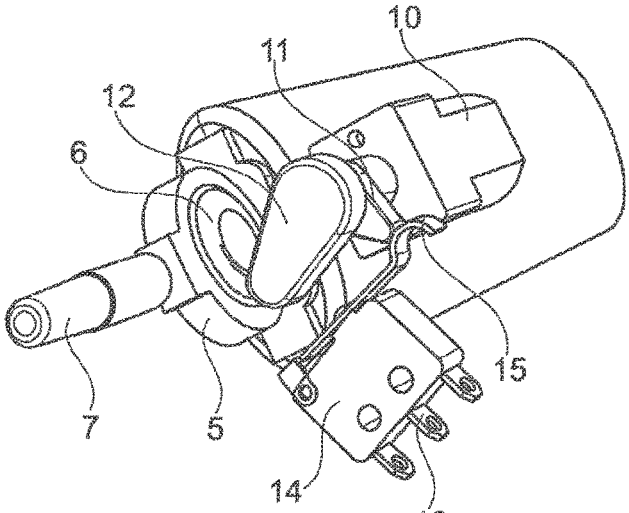
Figure 4:
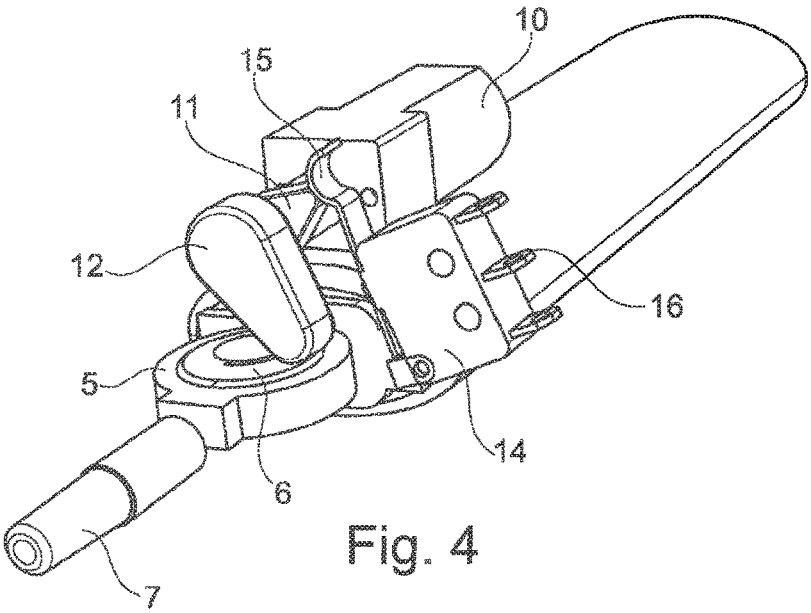
Figure 5:
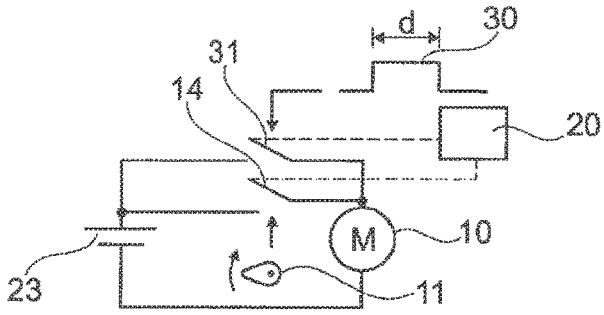

The invention may be better understood by reading the following detailed description of a non-restrictive example implementation, and by examining the attached drawing, in which:

FIG. 1 is a schematic and perspective representation of an example appliance according to the invention, FIG. 2 represents the appliance in FIG. 1, with a portion of the case removed, FIGS. 3 and 4 represent, from two different view angles, the pump actuating mechanism, and FIG. 5 is a simplified diagram of the electric circuit of the dispensing device.

The appliance (or device) 1 represented in FIG. 1 comprises a case 2, which houses, as visible in FIG. 2 in particular, a container 3 containing the product to be dispensed.

This container 3 is for example defined by a refill which is replaced when the product runs out, or, as a variant, the container is filled with product from a reserve outside of the product each time.

The appliance 1 comprises a pump 5 which, in the example considered, is a pump with a membrane 6, the pump being actuated by a movement of pressing and releasing of the membrane 6. Such pumps are known per se.

The pump 5 is supplied by the container 3 and when actuated, it pushes the product extracted in the container 3 toward a dispensing nozzle 7 connected to the head of the appliance 1. The latter may comprise any application body adapted to dispense the product delivered by the nozzle 7 on the human keratin materials. If applicable, the appliance 1 is also arranged to subject the region on which the product is applied to an electric current, facilitating the product's action, the appliance 1 in this case being an electrophoresis appliance, for example.

The appliance 1 may comprise an electrode, not visible, coming into contact with the composition, which conducts electricity, and a counter-electrode, not represented, held by the user so as to permit a current to circulate in the region treated.

The pump 5 comprises a body which is held fixedly by any suitable means in the case 2 of the appliance. An electric motor 10 is used to actuate the pump 5. This motor 10 causes a shaft, on which a first cam 11 and a second cam 12 are mounted, to rotate around an axis X.

In the example considered, the axis X is oriented substantially parallel to the longitudinal axis of the nozzle 7.

The first cam 11 is arranged to act on an electromechanical switch 14 such as a microswitch, comprising a lever 15 which causes the state of the switch to change when the lever is toggled.

The second cam 12 is arranged to act on the membrane 6 of the pump 5 so as to press on the latter and then release it, at each revolution around the axis X.

The motor 10 is geared such that the cam 12 has the force necessary to act on the pump 6.

An electronic restarting circuit 20, represented schematically in FIG. 5, is housed in the appliance 1 to control the operation of the motor 10.

The switch 14 is electrically connected in series to the motor 10 according to the diagram in FIG. 5, using conductors not represented, connected to the tabs 16 of the switch 14.

The appliance houses an electrical source 23 which provides the electrical energy necessary to power the electronic circuit 20 and the operation of the motor 10.

The cams 11 and 12 are angularly offset, such that the cam 12 can actuate the pump 5 for the latter to dispense a dose of product when the cam 11 completes a revolution with the departure and arrival point being the moment when the state of the switch changes because of the actuation of the lever 15. The latter is returned to resting position by a spring integrated in the switch 14, in a manner known per se.

The operation is as follows. It is assumed that the initial configuration is the one in FIGS. 3 and 4, the first cam 11 pushing the lever 15 to cause the switch 14 to change its state. In the example considered, when the lever 15 is moved by the cam 11, the switch 14 goes from an on state to a state where it becomes open. In the example considered, the motor 10 is electrically connected in series to the source 23 such that once the cam 11 has moved away from the lever 15 and the switch 14 returns to its resting configuration, the electric motor 10 is electrically powered via the switch 14, in the closed state.

The electronic circuit 20 comprises a timeout which makes it possible to apply a voltage window 30 to an electronic switch 31, such as, for example, a transistor, to turn it on, this switch 31 being mounted in parallel with the switch 14.

To dispense a dose of product, the user triggers the timeout, for example by pressing on a product dose dispensing control button connected to the electronic circuit 20, and the motor 10 starts up. The duration d of the timeout is long enough for the first cam 11 to leave the lever 15 and the switch 14 to return to its resting on configuration. Then, once the window 30 has elapsed, the switch 31 returns to an off state, but the rotation of the cam 12 may continue because of the closed state of the switch 14. This rotation continues until the first cam 11 again reaches the lever 15 and makes the switch 14 change its state to off, in which case the motor 10 stops. The rotation of the cam 12 during this cycle of operation has actuated the membrane 6 of the pump 5 and has led to the dispensing of a dose of product.

To recommence the dispensing of a dose, the dispensing cycle is started again by the issuing of a new window 30 by the electronic circuit 20.

Of course, the invention is not limited to the example which has just been described. For example, the switch 14 may not be a lever switch but a reed switch, comprising a blade that can move under the effect of a magnetic field, and the cam 11 is replaced by a wheel with a magnet that can act on this blade to change the switch's state for a certain angular position of the motor shaft.

The membrane pump 5 and the cam 12 may be replaced by a piston that can move in the container under the effect of the rotation of a threaded rod driven by the motor.

The invention claimed is:

1. A device for dispensing a fluid product, comprising:
- a container containing said product;
- an electric motor comprising a rotatably driven shaft;
- a dispensing system actuated by the rotation of the motor, a quantity of the product dispensed depending on the rotation of the motor;
- a switching body controlling the operation of the motor;
- a stop control element rotatably driven by the shaft, assuming an active position during the rotation thereof, wherein in said active position the stop control element causes the switching body to interrupt a power supply of the motor, and
- a restarting circuit comprising a switch, the restarting circuit arranged in such a way as to switch into an activated state, when triggered, wherein, in said activated state, the restarting circuit forces the starting of the electric motor when the stop control element is in the active position, the restarting circuit remaining activated for a period long enough for the stop control element to leave its active position, the restarting circuit then becoming inactive such that the motor stops operating when the stop control element regains its active position once the restarting circuit is inactive again, wherein in said activated state and during said period, power is supplied to said electric motor via the switch of the restarting circuit while the switching body is in the active position.

2. The device according to claim 1, wherein the switching body is an electromechanical switch.

3. The device according to claim 2, wherein the stop control element is a switch actuating cam arranged to press on the electromechanical switch.

4. A device for dispensing a fluid product, comprising:
- a container containing said product;
- an electric motor comprising a rotatably driven shaft;
- a dispensing system actuated by the rotation of the motor, a quantity of the product dispensed depending on the rotation of the motor;
- a switching body controlling the operation of the motor;
- a stop control element rotatably driven by the shaft, assuming an active position during the rotation thereof, wherein in said active position the stop control element causes the switching body to interrupt a power supply of the motor, and
- a restarting circuit comprising a switch, the restarting circuit arranged in such a way as to switch into an activated state, when triggered, wherein, in said activated state, the restarting circuit forces the starting of the electric motor when the stop control element is in the active position, the restarting circuit remaining activated long enough for the stop control element to leave its active position, the restarting circuit then becoming inactive such that the motor stops operating when the stop control element regains its active position once the restarting circuit is inactive again, wherein the switching body is an electromechanical switch, wherein the stop control element is a switch actuating cam arranged to press on the electromechanical switch, and wherein the switch actuating cam presses on the electromechanical switch when the stop control element is in an active position.

5. The device according to claim 2, wherein the electromechanical switch is electrically connected in series with the electric motor.

6. The device according to claim 1, wherein the restarting circuit comprises a timeout defining the period during which the restarting circuit remains active after being triggered, said period being short enough that the shaft makes only one turn after the restarting circuit is triggered.

7. The device according to claim 2, wherein the restarting circuit in the activated state short-circuits the switching body.

8. The device according to claim 1, wherein the dispensing system is a pump actuated by rotation of the shaft.

9. The device according to claim 8, comprising a pump actuating cam arranged so as to cause a pump body of the pump to move in an actuating stroke at each revolution of the shaft.

10. The device according to claim 3, wherein the dispensing system is a pump actuated by rotation of the shaft, wherein the device further comprises a pump actuating cam arranged so as to cause a pump body of the pump to move in an actuating stroke at each revolution of the shaft, and wherein the switch actuating cam and the pump actuating cam are angularly offset on the shaft, such that the switch actuating cam actuates the switch after the pump actuating cam has actuated the pump.

11. A device for dispensing a fluid product, comprising:

a container containing said product;

an electric motor comprising a rotatably driven shaft;

a dispensing system actuated by the rotation of the motor, a quantity of the product dispensed depending on the rotation of the motor;

a switching body controlling the operation of the motor;

a stop control element rotatably driven by the shaft, assuming an active position during the rotation thereof, wherein in said active position the stop control element causes the switching body to interrupt a power supply of the motor, and a restarting circuit comprising a switch, the restarting circuit arranged in such a way as to switch into an activated state, when triggered, wherein, in said activated state, the restarting circuit forces the starting of the electric motor when the stop control element is in the active position, the restarting circuit remaining activated long enough for the stop control element to leave its active position, the restarting circuit then becoming inactive such that the motor stops operating when the stop control element regains its active position once the restarting circuit is inactive again, wherein the dispensing system is a pump actuated by rotation of the shaft, wherein the device comprises a pump actuating cam arranged so as to cause a pump body of the pump to move in an actuating stroke at each revolution of the shaft, and wherein the pump is a membrane pump, the pump actuating cam pressing on the membrane of the membrane pump.

12. The device according to claim 2, wherein the switching body is a lever switch.

13. The device according to claim 1, wherein the switching body includes another switch that is mounted in parallel with the switch of the restarting circuit such that power is supplied to said electric motor via either said other switch of the switching body when the stop control element is no longer in the active position or via the switch of the restarting circuit when the stop control element is no longer in the active position.

14. The device according to claim 1, wherein the dispensing system is a pump actuated by rotation of the shaft, wherein the stop control element is a switch actuating cam, wherein the device further comprises a pump actuating cam arranged so as to cause a pump body of the pump to move in an actuating stroke at each revolution of the shaft, and wherein the switch actuating cam and the a pump actuating cam are angularly offset on the shaft such that the switch actuating cam actuates the switch after the pump actuating cam has actuated the pump.

15. The device according to claim 1, wherein the dispensing system is a membrane pump actuated by rotation of the shaft.

16. The device according to claim 1, further comprising a dispensing nozzle connected to a head of the device and arranged to dispense the product at said head.

17. The device according to claim 1, further comprising one or more electrodes arranged to permit a current to circulate in a region where the product is dispensed.

* * * * *